United States Patent [19]

Ballu

[11] Patent Number: 4,949,900

[45] Date of Patent: Aug. 21, 1990

[54] CARDBOARD CONTAINER FOR COMPACTING

[75] Inventor: Patrick J. N. Ballu, Reims, France

[73] Assignee: Caruelle, France

[21] Appl. No.: 351,029

[22] Filed: May 12, 1989

[30] Foreign Application Priority Data

May 16, 1988 [FR] France ..... 88 06518

[51] Int. Cl.[5] ..... B65D 5/24

[52] U.S. Cl. ..... 229/125.26; 100/229 A; 229/179; 229/180; 229/186; 229/907

[58] Field of Search ..... 229/125.25, 125.26, 229/125.28, 125.29, 125.31, 125.32, 171, 179, 180, 186, 23 R, 23 BT, 907, 125.21; 100/229 A

[56] References Cited

U.S. PATENT DOCUMENTS

| | | | |
|---|---|---|---|
| 1,302,507 | 5/1919 | Cady | 229/125.21 |
| 2,726,803 | 12/1955 | Ketler | 229/5.5 |
| 2,754,046 | 7/1956 | Roberts . | |
| 3,131,848 | 5/1964 | Floyd | 229/125.21 |
| 3,146,935 | 9/1964 | Carkhuff et al. | 229/125.26 |
| 3,531,041 | 9/1970 | Rohde | 229/125.26 |
| 3,536,249 | 10/1970 | Houston | 229/125.26 |
| 3,917,107 | 11/1975 | Bottas et al. | 100/229 A |
| 4,166,567 | 9/1979 | Beach, Jr. et al. | 229/125.26 |
| 4,254,903 | 3/1981 | Kuehlhorn | 229/125.26 |
| 4,700,623 | 10/1987 | Durbin et al. | 100/229 A |
| 4,711,390 | 12/1987 | Andrews et al. | 229/23 R |

FOREIGN PATENT DOCUMENTS

| | | | |
|---|---|---|---|
| 940099 | 1/1974 | Canada | 229/125.21 |
| 251945 | 1/1988 | European Pat. Off. . | |
| 2448375 | 4/1976 | Fed. Rep. of Germany . | |
| 2453083 | 10/1980 | France . | |
| 324383 | 6/1930 | United Kingdom | 229/125.21 |

*Primary Examiner*—Gary E. Elkins

*Attorney, Agent, or Firm*—Watson, Cole, Grindle & Watson

[57] ABSTRACT

A cardboard container which can be used in a compactor to contain domestic refuse, comprises a body and a cover. The container body is formed from a single blank by folding side panels thereof about a central panel forming the bottom. Corner panels folded along a diagonal ensure sealing relative to liquids located in the lower part of the container and provide handles which are retained and reinforced by flaps located on the body and on the cover and wound about the handles.

5 Claims, 3 Drawing Sheets

50
51
52
53
54
55
56
57
R
C
P

CARDBOARD CONTAINER FOR COMPACTING

BACKGROUND AND SUMMARY OF THE INVENTION

The present invention relates to a cardboard container for compacting and to a method of using this container.

The compacting of products, such as hospital, domestic or such like refuse, in order to reduce its volume and make it easier to handle and store it, involves the following operations:

the placing of an open container from above into a closed appliance called a compactor, the at least partial filling of the container with products to be compacted, the compression of the products by means of a hydraulic or electronic jack which lowers into the container the horizontal pressing plate of an area slightly smaller than that of the bottom of the container, until the volume of the products has been reduced, for example, to one third of the initial volume, the depositing of new products on the compacted bed followed by a new compacting, until the container is substantially full of compacted product.

In some embodiments, the container is lined on the inside with a plastic bag before it is filled, and at the end of the operation the plastic bag is removed together with the compacted mass which it contains.

In other embodiments which conform more closely to the regulations relating to hospital waste, the container is made of cardboard. It is fully lined with a plastic bag on the inside, but after compacting the cardboard container is discharged without removing the plastic bag from it, after equipping it with a cardboard cover.

The container body is produced in a conventional way from a blank which is folded and glued or stapled to form a rectangular cardboard tube equipped with flaps which are fastened by means of adhesive tapes to form the bottom.

This solution is more satisfactory than the first in terms of pollution, because the accidental bursting of the plastic bag has no serious consequence, except when the adhesive tapes do not ensure perfect sealing, in which case the liquids can escape. However, it is more complicated to use and costly.

The object of the present invention is to provide a container which has the advantages of stability and sealing of a cardboard container lined with a plastic bag, without having its complicated use, and which is of a relatively low cost price.

The invention therefore provides a cardboard container for compacting, composed of a body and a cover, the body being formed by folding a single blank and the cover being formed by folding another single blank, the particular features of which are that the blank for forming the body comprises a rectangular or square central panel to form the bottom, four front or lateral panels to form the sides, each connected to one side of the bottom by means of a folding line, and four corner panels, each adjacent to two lateral sides and foldable on themselves along a diagonal passing through an apex of the bottom panel, these corner panels having cutouts intended for constituting handles for handling the container after folding, the blank also possessing two foldable flaps on the outer edge of two mutually opposite lateral panels, these flaps being intended to be folded round the handles in order to retain them against the side carrying the flap, and the blank for forming the cover comprises a central panel of dimensions equal to or slightly smaller than those of the bottom panel of the container body, so as to be capable of entering the body forcibly, the central panel of the cover also carrying, on each of the two opposite sides, a foldable flap intended to be folded round the corresponding flap of the body and to be inserted by means of its end between the side of the body and the noted flap of the body, in order to retain it in turn.

The special structure of the container, with a bottom integral with the four sides and with the corner panels, ensures that there can be no escape of liquids as long as the container is intact and has suitable impermeability. To achieve this, the container is preferably made of cardboard rendered impermeable or plasticized on the outside and/or on the inside. Suitable grades of cardboards are on the market at the present time.

On the other hand, the lateral handles, whilst assisting handling, reinforce the sides of the container. Finally, the cover, locked by means of its flaps, does not risk being removed in an undesirable way.

Preferably, the sides of the body which do not carry the noted flaps, on their edge opposite the bottom, carry second smaller flaps intended to be folded inwards and having projections intended for penetrating into notches or holes in the cover after the latter has been driven into the container, so as to lock the noted second flaps and the noted cover.

This arrangement, by securing the cover of the container body on four sides, strengthens the container for the transport of the compacted product and effectively prevents any opening of the cover as a result of the deformation of the latter and/or of the container body. In this case, the cover advantageously has second flaps intended to be inserted between the corresponding side and the second flap carried by this side, the noted holes in the cover, which are intended for receiving the projections of the second flaps of the sides of the body, being provided on the corresponding folding lines or near these.

The result of this arrangement is that it further improves the sealing and security of closure of the cover without any additional complication in use. At the same time, it increases the rigidity of the edges of the container body.

The invention also provides a method of using the container according to one of the preceding claims, involving the following steps:

the formation of the container body from a blank received flat, by bending the front and transverse panels, and the formation of the handles together with the winding of the corresponding flaps, the introduction of the container body, open at the top and one of the handles at the front, into a compacting machine comprising a containment limited by three vertical walls and a door, this door being arranged so as to keep itself firmly up against a front wall of the container when the opposite front wall bears on the bottom of the container, this compacting machine also possessing a vertically moveable pressing device intended for carrying out the compacting and at least one device capable of moving one of the lateral walls of the containment, the clamping of the container between the two lateral walls of the containment and between the door and the bottom of the containment, the introduction of products to be compacted into the container, followed by the compacting of these products, these operations being repeated several times, if necessary, the placing of the cover on the container, the driving of the cover into the container by means of the pressing device, until the second flaps of the cover, if there are any, pass under the second flaps of the container body, and the release of the pressing device in order to obtain the snapping of the said projections into the holes or notches, the opening of the door of the containment, the parting of the lateral walls of the containment and the removal of the container containing the compacted product, the winding of the first flaps of the cover on the handles, the discharge of the closed container.

The advantage of the method is that the container comes out of the compacting containment already closed, with less risk of contamination, especially for the personnel. Moreover, since the lateral walls are moved apart from one another before the container is removed from the containment, the latter does not risk being jammed and damaged there.

The invention will now be described in more detail by means of a practical example illustrated in the drawings.

DETAILED DESCRIPTION OF THE PREFERRED EMBODIMENT

Figure 1:
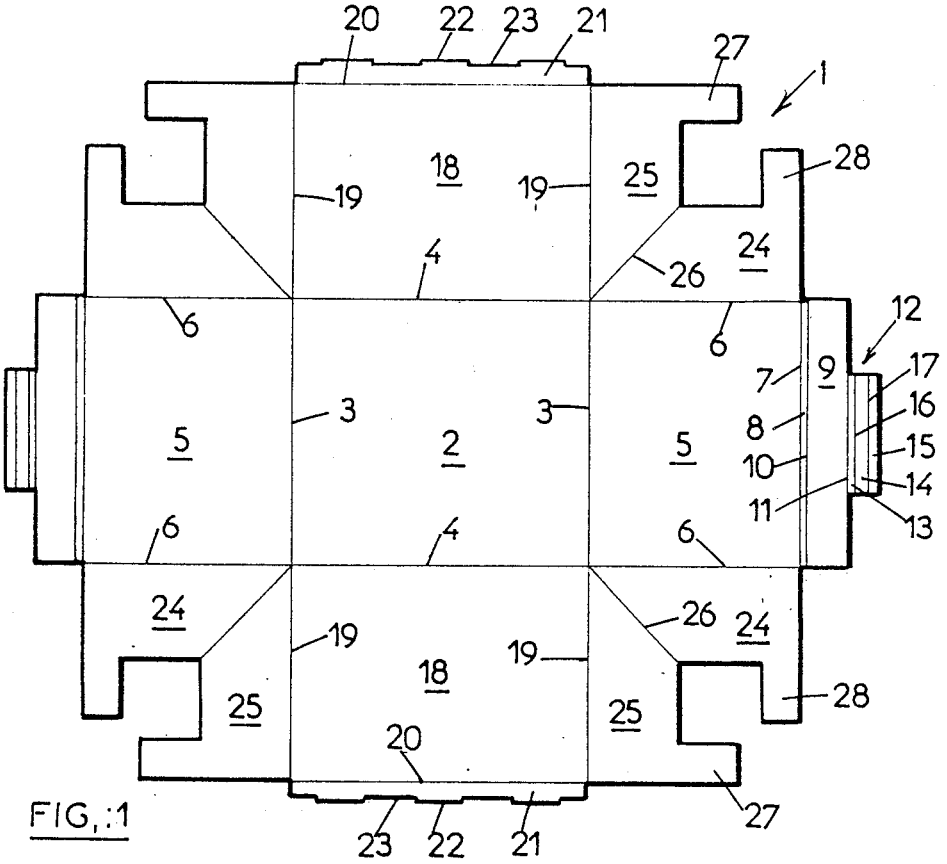
FIG. 1 is a plan view of the blank intended for making the container body.

The blank 1 intended for forming the container body comprises, as can be seen in FIG. 1, a bottom panel 2 of rectangular form, with two front sides 3 and two lateral sides 4 a little larger than the front sides. The sides 3 and 4 consist of folding lines. Along each front folding line 3 extends a front panel 5 intended for forming a front wall of the container. The front panel 5 is rectangular and is limited not only by the folding line 3, but also by two lateral folding lines 6 extending the lateral sides 4 and by a front folding line 7 facing the line 3. The folding lines 3, 4, 6 are designed for folding towards the centre of the bottom panel 2, whilst the folding line 7 is designed for folding in the opposite direction.

The panel 5 is extended beyond the line 7 by two panels 8 and 9, of which the length counted in the direction away from the bottom panel 2 is much smaller than that of the panel 5, but of which the width counted in the direction perpendicular thereto is the same as that of the panel 5. The panel 8 is of a length equal to only a few times the thickness of the cardboard of which the blank is made, whereas the panel 9 has an appreciably greater length. The panels 8 and 9 are separated by a folding line 10 arranged in the same way as the line 7 for folding towards the outside of the container to be formed. The panel is connected, by means of a folding line 11 arranged in the same way as the folding line 10, to a flap 12 composed of three successive panels 13, 14, 15 separated by folding lines 16, 17 arranged in the same way as the folding line 11. The flap 12 arranged in the middle of the width of the panel 9 has itself a width approximately equal to half the latter.

The lateral panels 18 separated from the central bottom panel 2 by the folding line 4 have a length, counted in the direction away from the panel 2, which is equal to that of the front panels 5. They are limited not only by the line 4, but also by two front folding lines 19 extending the lateral sides 3 and by a lateral folding line 20. Beyond the folding line 20 is a flap 21, the outer edge of which has a series of projections 22 and 23, the use of which will be seen later. The folding line 20 is designed for the inward folding of the flap 21, in the same way as the folding line 4.

Two corner panels 24 and 25 extend beyond the folding lines 6 and 19. These panels are separated by a folding line 26 which extends diagonally from one of the apices of the bottom panel 2, that is to say from the meeting point of the lines 6 and 19. The corner panels 24, 25 each have a general L-shaped form, that is to say the diagonal folding line 26 does not extend as far as the opposite angle of the square defined by the lines 6 and 19, but in the middle of this square gives way to an indentation which is itself substantially square and which defines, in each of the panels 24, 25, a somewhat wide rectangular tab 27, 28 which projects in the opposite direction to the respective folding line 19 or 6 over a length equal to half the width of the flap 12.

Figure 2:
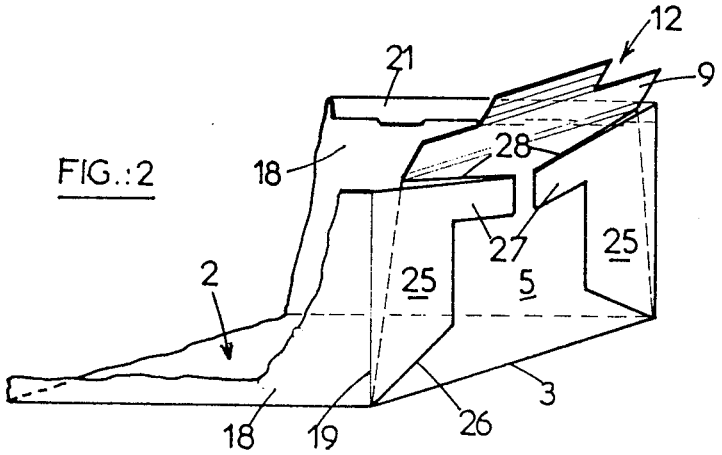
FIG. 2 is a perspective drawing illustrating the assembly of the ends of the container body and the handles.
Figure 3:
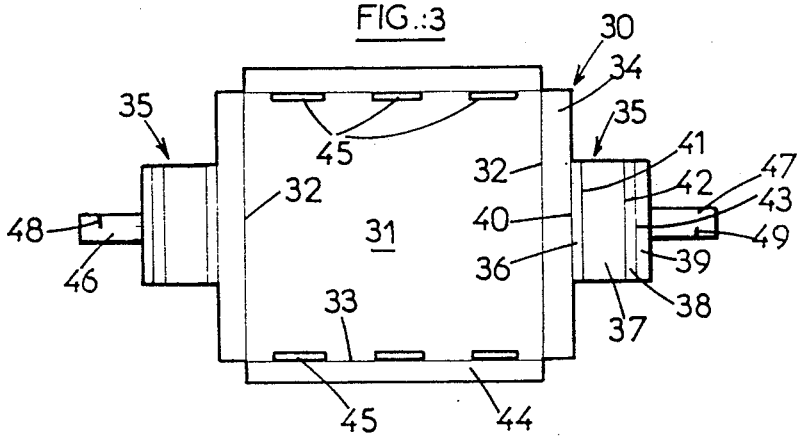
FIG. 3 is a plan view of the blank intended for forming the cover.

FIG. 2 shows the folding principle for obtaining the container body. After the bottom panel 2 has been laid flat, the two front panels 5 and the two lateral panels 18 are raised simultaneously. This movement causes the folding of the corner panels 24 and 25 along the folding line 26. The folding lines 6 and 19 are in opposite directions and are designed to ensure that all the corner panels 24 and 25 turn down onto that face of the panel 5 which is on the outside in relation to the centre of the container. During the movement, the extensions 27 become horizontal, to form insipient handles The flap 12 surrounds the two extensions 27, 28 to form the actual handle.

The blank 30 intended to constitute the cover is of simpler form and comprises a central panel 31 of rectangular form and of dimensions very slightly smaller than those of the bottom panel 2, to allow for the thickness of the cardboard. In fact, the cover must be capable of entering the container, once assembled. The panel 31 is limited by front folding lines 32 and lateral folding lines 33, all designed to allow the adjacent panels to turn down inwards, as though to form the bottom of a new container. Beyond the folding line 32 is a front panel 34 of a length, counted in a direction away from the panel 31, appreciably smaller than that of the latter. The panel 34 is extended by a flap 35 which comprises four panels 36, 37, 38, 39 arranged in the middle of the panel 34, but of a width approximately half that of the latter. The flap 35 is connected to the panel 34 by means of a folding line 40 directed opposite to the folding line 32, and the various panels 36, 37, 38 and 39 are separated from one another by folding lines 41, 42, 43, all of the same direction as the folding line 40. The length of the panel 37 is approximately equal to that of the panel 9 of the blank 1, plus twice the thickness of the cardboard. The length of the panels 36 and 38 is equal to a few times the thickness of the cardboard.

The folding line 33 is bordered by a panel 44 of the same length as the panel 34. Along the folding line 33 there is, in the panel 31, perforations 45 of a number equal to that of the projections 22 of the flap 21 of the blank 1. In fact, the projections 22 are intended for penetrating into these perforations.

To close the container, it is sufficient to drive the cover into the latter, and the edges of the container push back the panels 34 and 44 and automatically turn them down inwards.

Figure 4:
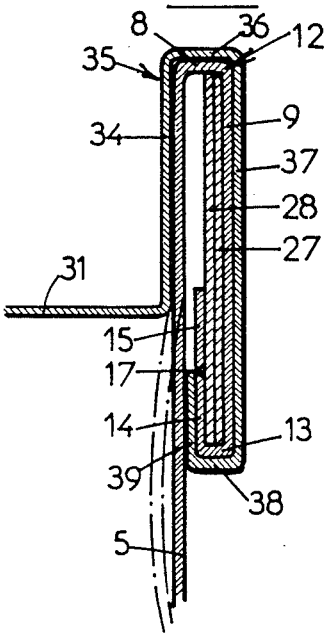
FIG. 4 is a vertical section through the handle, the cover being in place.

FIG. 4 shows the formation of the handle, after the cover has been put in place. The flap 35 of the cover winds round the flap 12 of the container body and reinforces the handle. If the structure of the latter is examined in more detail, as indicated in FIG. 4, it will be seen that it comprises a central core consisting of the two extensions 27 and 28 surrounded by the panels 8, 9, 13, 14 and 15 of the container body, themselves surrounded by the panels 36, 37, 38 and 39 of the cover. Dot-and-dash lines represent the deformation of the panel 5 of the container body, which, because it is of a single thickness, can be pushed back sufficiently to allow the hand to be inserted under the handle.

Figure 5:
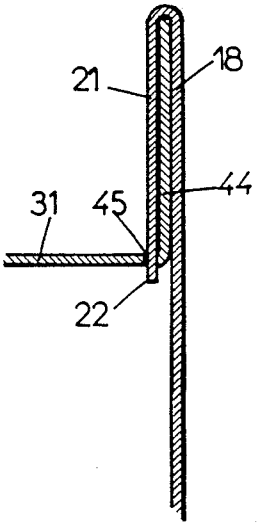
FIG. 5 is a sectional view of a lateral edge of the container and of the cover, the latter being fastened to the container.

FIG. 5 is a cross-section in a direction perpendicular to that of FIG. 4, showing the structure of an upper lateral edge of the container, the cover being put in place. The flap 21 connected to the panel 18 is turned down over the panel 44 connected to the central panel 31 of the cover, and the projections 22 penetrate into the perforations 45 for the purpose of locking.

It will be seen that the cover cannot escape upwards because it is retained by the flap 21 over the entire length of the lateral side, and it cannot sink downwards because it is retained by its flap 35 interacting with the flap 12. A firm and virtually leak-proof closure is therefore obtained.

To make it easier to handle the cover, advantageously the flaps 35 are immobilized. A simple procedure can involve equipping each of them with a tab (connector) 46, 47, each of them having a slot 48, 49, these slots being arranged in such a way that each tab can be retained by the slot of the other, the flaps being folded onto the top of the cover.

The method of using the containers according to the invention is illustrated in FIGS. 6 to 10.

Figures 6, 7, 8, 9, 10:
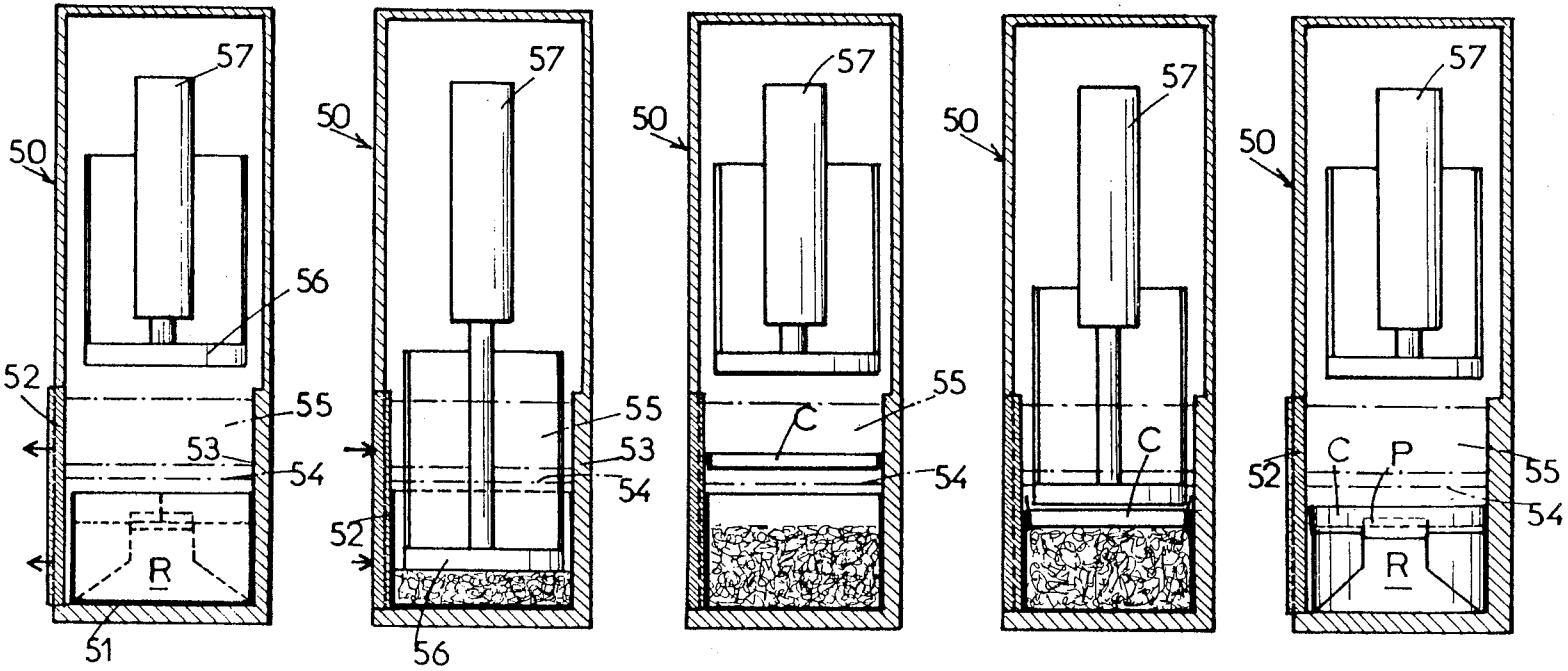
FIGS. 6 to 10 are explanatory diagrams illustrating phases in the method according to the invention.

A compacting appliance or compactor 50 has a parallelepipedic containment with a bottom 51, two lateral walls 52, 53, at least one of which is moveable, a fixed rear wall and a front wall having a lower door 54, represented by dot-and-dash lines in FIG. 6 for the entry and exit of the container and an upper door 55, likewise represented by dot-and-dash lines in FIG. 6, for introducing the products to be compacted. The top of the compactor is equipped with a horizontal pressing plate 56 of a dimension very slightly smaller than that of the interior of the container, which can be lowered by means of a jack 57.

FIG. 6 shows how the previously assembled container R is put in place. To make introduction easier, one lateral wall 52 is moved apart from the other wall 53. The container R is introduced with a handle at the front.

The lateral wall 52 is subsequently brought closer to the wall 53 opposite it, and the door 54 is closed. The container is then at a very short distance from the four vertical walls surrounding it or is in contact with them.

Products to be compacted are then introduced via the upper door 55, and the pressing plate 56 is lowered in order to carry out the compacting, see FIG. 7. The walls of the container undergo only a very slight outward bulging because of the proximity of the vertical walls.

After a sufficient number of compacting operations, when the container has reached the desired filling, the cover C is placed on the container R (see FIG. 8), and the pressing plate 56 is lowered once again (see FIG. 9), the effect of this being to drive in the cover C until the second flaps 44 of the cover pass underneath the second flaps 21 of the container. When the pressing plate rises again, the elasticity of the compacted products pushes the cover C upwards, the effect of this being to cause the flaps 44 of the cover to pass between the side 18 of the container and the corresponding flap 21, as indicated in FIG. 5. The projections 22 penetrate into the holes 45, with the result that the cover is locked in the container.

All that remains now is to open the lower door 54 and move apart the lateral wall 52 to make it possible to withdraw the closed container by means of one of its handles P.

The handles will subsequently be reinforced by the winding of the flaps 35 according to FIG. 4.

What is claimed:

1. A cardboard container in which materials can be compacted and retained, said container comprising a body and a cover, said body being formed from a first flat blank which has fold lines so as to define a generally rectangular central panel, two opposite front panels, two opposite lateral panels, four corner panels, and respective first projections extending away from said front panels in a direction opposite said central panel, each corner panel including an indentation that provides a tab and a diagonal fold line, said central panel, when said first blank is folded along said fold lines, providing a bottom wall of said body, said front panels providing opposite front walls of said body, said lateral panels providing opposite side walls of said body, said tabs of respective corner panels adjacent each front wall extending towards one another outwardly of the adjacent front wall, and each first projection extending from a front wall being folded over tabs located outwardly of said front wall to provide a handle, and said cover being formed from a second flat blank which has fold lines so as to define a generally rectangular central section, two opposite front sections, and respective second projections extending from said front sections in a direction opposite said central section, said cover being insertable between the front and side walls of said body to retain material in said body, said second projections being extendable over said handles and between said handles and the adjacent front wall.

2. A cardboard container as claimed in claim 1, wherein said first flat blank includes respective side flaps extending away from said lateral panels in a direction opposite said central panel, said side panels, when said first blank is folded along said fold lines, extending downwardly towards said bottom wall and including third projections, and said second flat blank including perforations in which said third projections can extend when said cover is inserted therebelow in said body.

3. A cardboard container as claimed in claim 2, wherein said second flat blank includes two opposite lateral sections which can be folded relative to said central section so that when said cover is inserted in said body said lateral sections can become inserted between said downwardly-extending side flaps and side walls of said body and thereby lock said cover in said body.

4. A cardboard container as claimed in claim 1, including connectors respectively attached to said second projections of said second flat blanks which can be interconnected.

5. A method compacting and storing materials which comprises the steps of:

(a) providing a first flat blank which has fold liens so as to define a generally rectangular central panel, two opposite front panels, two opposite lateral panels, four corner panels, and respective first projections extending away from said front panels in a direction opposite said central panel, each corner panel including an indentation that provides a tab and a diagonal fold line, (b) providing a second flat blank which has fold lines so as to define a generally rectangular central section, two opposite front sections, and respective second projections extending from said front sections in a direction opposite said central section, (c) folding said first flat blank so as to form a body having a bottom wall, front walls, side walls and handles provided by each first projection folded over the tabs of adjacent corner panels, (d) compressing material in said body one or more times, (e) pressing said second flat blank into said body over the compressed material therein so that said central section thereof moves between said front and side walls and towards said bottom wall of said body, and (f) wrapping said second projections of said second flat blank respectively over said handles and between said handles and an adjacent front wall of said body.

* * * * *